United States Patent [19]

Anderson

[11] Patent Number: 4,734,938

[45] Date of Patent: Apr. 5, 1988

[54] I.D. SOCKS (IDENTIFICATION SOCKS)

[76] Inventor: Bruce R. Anderson, 13425 Gunflint Ct., Apple Valley, Minn. 55124

[21] Appl. No.: 815,725

[22] Filed: Jan. 2, 1986

[51] Int. Cl.[4] ..... A41B 11/00

[52] U.S. Cl. ..... 2/239

[58] Field of Search ..... 2/239, 240; 66/186, 66/178 R, 180, 136; 28/164; 40/586

[56] References Cited

U.S. PATENT DOCUMENTS

| | | | |
|---|---|---|---|
| 2,569,434 | 9/1951 | Ischlinger | 66/178 R X |
| 3,135,442 | 6/1964 | Carter, Jr. | 2/239 X |
| 4,034,581 | 7/1977 | Swafford | 66/136 X |
| 4,096,655 | 6/1978 | Ullman, Jr. | 40/2 R |
| 4,104,892 | 8/1978 | Thorneburg | 2/239 X |
| 4,344,240 | 8/1982 | Schiller | 40/20 R |

*Primary Examiner*—H. Hampton Hunter

*Attorney, Agent, or Firm*—Kinney & Lange

[57] ABSTRACT

A sock (hosiery) with identification markings includes the sock, a written word description of the color of the sock, and a symbol or symbols. The word description and the symbol are permanently integrated into the sock. The user uses the markings to pair the socks after laundry, to identify the color of the socks in poor light conditions, and to keep original pairs of socks together.

10 Claims, 1 Drawing Sheet

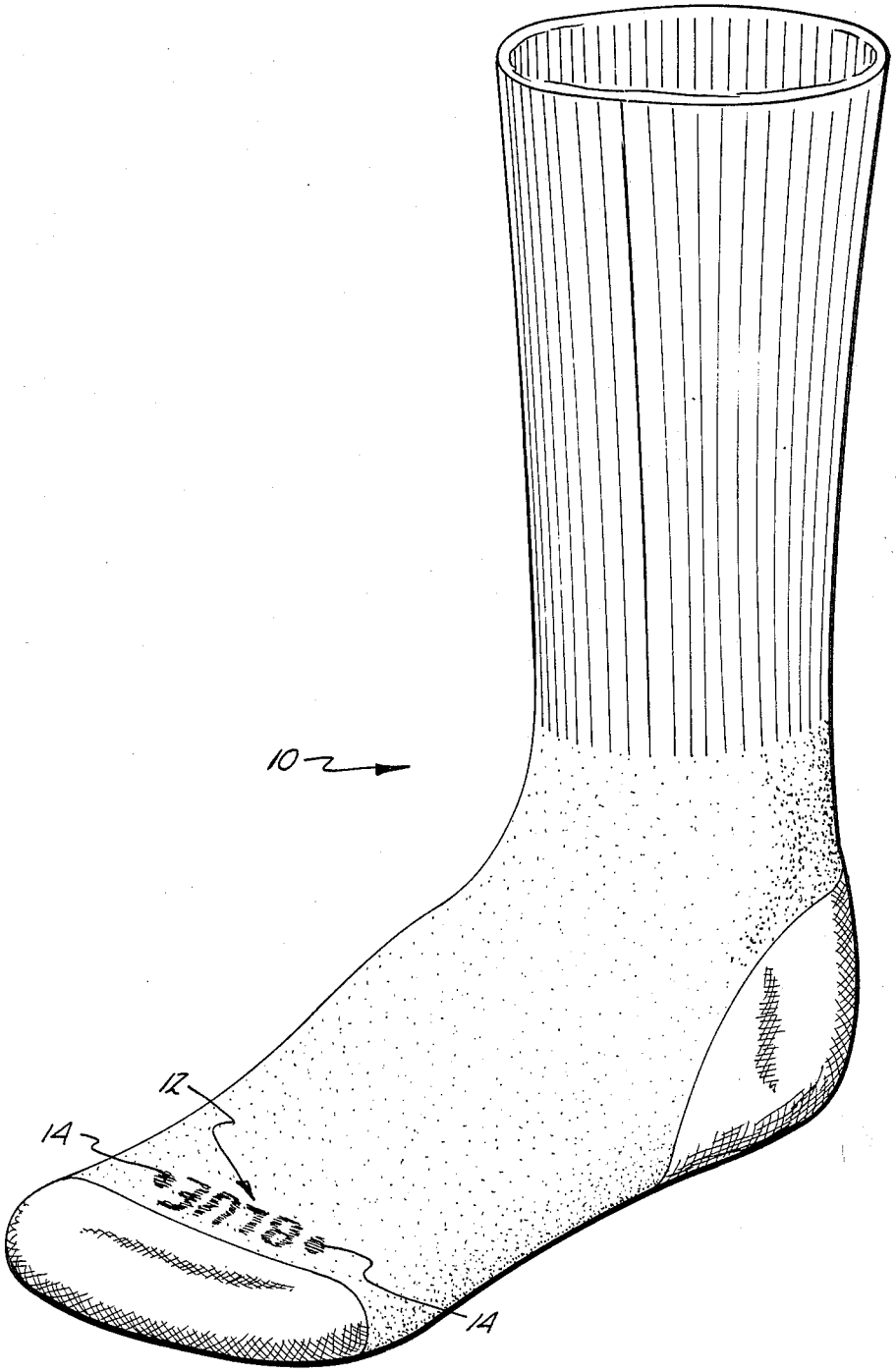
10
12
14
14

I.D. SOCKS (IDENTIFICATION SOCKS)

BACKGROUND OF THE INVENTION

This invention relates in general to socks and in particular to men's dress socks, but not limited to this category only.

Socks, for example, men's dress socks, are composed of various materials and are usually of dark, solid colors. Being of this nature, when a week's laundry is done there are many single dark socks which are difficult and tedious to pair back together. A further disadvantage is that in poor lighting conditions, as the early morning hours, it is very difficult for the businessman to tell what color socks he is putting on. A still further disadvantage is when a person has more than one pair of identical socks, bought at different times, it is difficult to pair them up based on the age of the pairs. Socks have previously been marked in a variety of manners for numerous reasons. For example, U.S. Pat. No. 4,104,892 to Thorneburg discloses a cushioned sole tube sock which is marked in order to show the proper wearing position of the sock on the foot. That is, the Thorneburg sock has a special cushioned sole formed of terry loops designed to be worn under the ball and heel of the foot. The markings on the sock consist of colored stripes which indicate the location of the terry loops. Similarly, U.S. Pat. No. 3,995,322 to Chesebro discloses a cushioned top sock having cushioning to protect the ankle during wear of a ski boot. Color bands are used to indicate the location of the specially cushioned areas of the sock and ultimately are used for proper positioning of the sock on the foot during wear. Swafford U.S. Pat. No. 4,034,581 discloses a sock having a plate and float pattern of manufacturing. Auton U.S. Pat. No. 3,181,316 discloses a method of weaving closely spaced diamond shaped designs into a sock.

It is desirable to have socks which are marked in a manner such that their color may be determined under most lighting conditions. Ordinarily, it can be difficult to distinguish between a navy blue, black or dark brown sock under poor lighting conditions commonly encountered when getting dressed in the early morning. In addition, it is desirable to mark a sock in manner such that a person who is unable to distinguish colors and shades, for example, a color blind person, can know the color of the sock.

It is also desirable to mark socks so as to indicate pairs thereof. Presently, it is impossible to tell whether two socks of the same color were originally of the same pair where more than two socks of the same color are present. In particular, this problem is encountered following laundering of the socks. Sorting of socks after laundering would be facilitated by the use of pair indicating indicia.

While the above listed patents provide various markings, none of the above patents in any way suggest the use of markings to designate color and pairs of socks.

SUMMARY OF THE INVENTION

An I.D. sock according to one embodiment of the present invention comprises a sock with the color of the sock written into the sock along with a symbol or symbols.

One object of the present invention is to separate socks after laundry. With multiple single socks you can easily pair them together by matching the indicated color and symbol.

A second object is to make it easy to tell what color the socks are in poor light. With I.D. socks you just read what color they are. This is also helpful for the color blind.

A third object is to keep pairs together based on the use of each pair of similar socks. You keep multiple pairs or identical pairs of socks separate by buying different symbols of each pair. Then through time they are kept together by symbols.

Advantages of the present invention will be apparent from the following description.

BRIEF DESCRIPTION OF THE DRAWINGS

FIG. 1 is an overall plan view of the dress sock having color and pair indicating indicia or designating marks according to the present invention.

DETAILED DESCRIPTION OF THE PREFERRED EMBODIMENTS

A dress sock having indicia to indicate or markings to connote color and pairs thereof is generally indicated at 10 of FIG. 1. The dress sock 10 is similar in construction to premium dress socks commonly available. In addition, the materials used are similar to those used in the manufacturing of other dress socks. A color indicating indicium or designating mark 12 is knitted into the sock at a location not visible during wear. The color indicating indicium mark 12 comprises the name of the color of the sock. For example, as shown at 12 in FIG. 1, the word "blue" has been knitted into the sock. Preferably, the color indicating indicium mark 12 would be of a size sufficient to allow easy reading under most lighting conditions. In addition, the color indicating indicium mark 12 is knitted in a color different from the body of the sock 10 such that there is a sufficient contrast between the two colors. This contrast will facilitate reading of the color indicating indicium mark 12 by persons unable to distinguish colors or shades.

The pair indicating indicium or designating mark 14 comprises a pair of symbols which are knitted into the sock 10 on either side of the color indicating indicium 12. The pair indicating indicium mark 14 may be one of a plurality of geometric symbols, such as triangles, stars, diamonds, squares, circles, etc. The pair indicating indicium 14 may be used to facilitate sorting of the socks after laundering. In addition, the pair indicating indicium mark 14 will permit pairs of socks to be kept together for even wear.

The color indicating indicium 12 and the pair indicating indicium 14 are oriented on a color line 16. This orientation permits easier reading of the color and pair indicating indicia 12, 14. Again, the color line 16 is positioned at a point on the sock not visible during wear.

The pair indicating indicium 14, as stated above, comprises a pair of any one of a set of geometric symbols. By using a wide variety of symbols, a person can own several pairs of the same color of dress socks without having the same symbol on more than one pair.

Although the present invention has been described with reference to preferred embodiments workers skilled in the art will recognize that changes may be made in form and detail without departing from the spirit and scope of the invention.

What is claimed is:

1. A method of marking socks for designation of sock color and of sock pair comprising:

interweaving each sock or sock pair with a first knit marking for designation of sock color having a contrasting color to that of the sock; and interweaving a second knit marking of a geometric symbol for designation of the color shade of a matching sock pair having a contrasting color to that of the sock whereby socks originally paired can be easily maintained together.

2. The method of claim 1 wherein interweaving the first and second knit markings to the sock includes forming a uniform sock surface.

3. The method of claim 1 wherein interweaving the first and second knit markings to the sock includes forming a non-uniform sock surface.

4. The method of claim 1 wherein the first knit marking for designation of sock color includes letters spelling out the sock color.

5. The method of claim 4 wherein each sock of the sock pair includes the same first knit marking for designation of sock color.

6. The method of claim 1 wherein the second knit marking for designation of sock pair include a pair of symbols.

7. The method of claim 6 wherein each pair of symbols includes the same symbol.

8. The method of claim 7 wherein each sock of the sock pair includes the same pair of symbols as second knit marking for designation of sock pair.

9. The method of claim 8 wherein two second knit markings for designation of sock pair adjoin the first knit marking for designation of sock color, each of the Second knit markings for designation of sock pair located on either side of the knit marking for designation of sock color.

10. The method of claim 9 wherein each sock of the sock pair includes a plurality of first knit markings for designation of sock color and a plurality of second knit markings for designation of sock pair.

* * * * *